United States Patent [19]

Rumberger et al.

[11] Patent Number: 5,074,325

[45] Date of Patent: Dec. 24, 1991

[54] PIVOTING CONTROL VALVE ACTUATOR AND SUPPORT ASSEMBLY

[75] Inventors: Ronald F. Rumberger, King, N.C.; Patrick W. Dunn, Winter Springs, Fla.

[73] Assignee: Westinghouse Electric Corp., Pittsburgh, Pa.

[21] Appl. No.: 481,035

[22] Filed: Feb. 16, 1990

[51] Int. Cl.[5] ..... F16K 31/163; F16K 43/00

[52] U.S. Cl. ..... 137/15; 74/102; 92/118; 92/140; 137/315; 251/58; 251/635; 251/229; 415/126; 415/151; 415/157

[58] Field of Search ..... 251/58, 62, 63.5, 63.6, 251/229, 279, 231, 242, 243; 74/102; 92/118, 140; 415/126, 148, 150, 151, 156, 157; 137/15, 315

[56] References Cited

U.S. PATENT DOCUMENTS

| | | | |
|---|---|---|---|
| 465,477 | 12/1891 | Johnson | 251/58 |
| 528,483 | 10/1894 | Nixon | 251/58 |
| 677,940 | 7/1901 | Carr | 251/58 |
| 1,075,574 | 10/1913 | Johnson | 92/118 |
| 1,130,406 | 3/1915 | Jensen | 92/118 |
| 2,386,589 | 10/1945 | Caldwell | 92/118 |
| 3,225,612 | 12/1965 | Topinka | 74/102 |
| 3,296,877 | 1/1967 | Flick et al. | 74/102 |
| 3,684,237 | 8/1972 | Hyde et al. | 251/58 |
| 3,970,280 | 7/1976 | Kunz | 251/58 |

FOREIGN PATENT DOCUMENTS

| | | | |
|---|---|---|---|
| 1134864 | 8/1962 | Fed. Rep. of Germany | 251/58 |

*Primary Examiner*—George L. Walton

[57] ABSTRACT

A steam turbine control valve actuator for lever-operated control valves includes a servomechanical actuator with a reciprocable rod. Such servomechanical actuator is mounted upon a support assembly that is, in turn, pivotably mounted to the control valve body. A distal end of the rod is coupled by a knuckle joint to one end of the lever which operates the control valve, and forces of the rod are biased by a spring that substantially eliminates side forces on the rod through maintenance of the effort that is applied to the lever by the rod in a direction that is parallel to the rod.

20 Claims, 4 Drawing Sheets

PIVOTING CONTROL VALVE ACTUATOR AND SUPPORT ASSEMBLY

BACKGROUND OF THE INVENTION

1. Field of the Invention

This invention relates generally to steam turbine control valves, and more particularly to assemblies used in actuating such steam turbine control valves.

2. Statement of the Prior Art

Admission of steam to steam turbines is typically controlled by way of a plurality of control valves which is installed in steam chest portions of the steam turbine. In prior art steam turbine control valve systems, each control valve is actuated open and closed by various suitable means including pneumatic, hydraulic, and electrohydraulic means. The stems of such control valves are, in most cases, raised to open and lowered to close the control valve mechanically through linkages including a lever.

For example, FIGS. 1 and 2 illustrate one typical actuator means that is presently used for opening/closing a steam turbine control valve. The control valve 10 is shown attached, through its valve stem 12, to a lever 14 point A. One end of lever 14 is rotatably coupled to a portion 16 of the steam chest of a conventional steam turbine (not shown) by a first link 18, while the other end of the lever 14 is rotatably coupled to a reciprocable piston rod 20 through a second link 22. As is well known, the piston rod 20 forms part of a conventional servomechanism 24 which actuates the control valve 10 between its closed position as is shown in FIG. 1 to an open position shown in FIG. 2. Servomechanism 24 typically includes an actuator 26 to push the piston rod 20, and a control block manifold 28 to control the actuator 26.

One problem that is frequently encountered in using such lever-operated steam turbine control valves is the "side forces" that may impact upon the piston rod 20 throughout its stroke. When the control valve 10 is closed as shown in FIG. 1, there are no such side forces which affect the piston rod 20 because its actuating forces are at rest. However, as the control valve 10 moves towards an open position shown in FIG. 2, resultant side forces $F_{side}$ are imposed on the piston rod 20 due to the force $F_{link}$ acting off of the vertical. The magnitudes of these side forces $F_{side}$ are proportional to the angle from which the second link 22 is offset from the piston rod 20.

Another problem that is also frequently encountered in using such lever-operated steam turbine control valves are the large moments and resulting forces that are placed on the actuator and its support assembly. Since these actuators are typically mounted upon the side of the control valve body, in the manner shown in FIGS. 1 and 2, they require not only many extensive and often inaccurate support analyses, but also the use of retrofitted, adjustable jackscrews to ensure that they are properly supported. These forces cause large deflections of the support assemblies from their respective control valve bodies upon which they are mounted. Furthermore, the control valve themselves are subjected to a great deal more heat than the support assemblies which are mounted thereon. It will be appreciated, therefore, that any adjustment of the stiffening jackscrews will be difficult because the control valve bodies will expand significantly more than their support assembly.

A related problem to these large moments and forces is the concomitant requirement to manufacture larger, stronger and more complex support assemblies to counteract such moments and forces. More often than not, these support assemblies are made of cast components. A simpler manufacturing design would be more desirable.

SUMMARY OF THE INVENTION

Accordingly, it is a general object of the present invention to provide an improved actuator for a steam turbine control valve. It is a more specific object of the invention to provide control valve actuators which are adapted to pivot in order to avoid any problem of "side forces" that have been experienced in the prior art.

Another object of the invention is to provide means for actuating lever-operated control valves which avoids such side forces, and is simpler and less expensive to manufacture.

Briefly, these and other objects according to the present invention are accomplished in a steam turbine with a control valve for controlling an admission of steam into the steam turbine, a valve stem that is connected to the control valve, means for operating the control valve that includes a control block adapted to receive control signals to open and close the control valve, and an actuator with a reciprocable rod extending therefrom, lever means to operate the control valve that includes a fulcrum that is attached to the valve body, first coupler means for providing resistance to the fulcrum and rotatably coupling the valve stem to the lever means, and second coupler means for applying an effort to the fulcrum while rotatably coupling the reciprocable rod to the lever means, by means for maintaining the applied effort along a line that is parallel to the rod.

The effort maintaining means generally comprises pivotable means for enabling the operating force of the rod to be continuously transmitted through the centerline of the second coupler means throughout the entire stroke of the rod. Therefore, pivoting control valve actuators according to the present invention further comprise an assembly for supporting the operating means, and for housing the effort maintaining means with the second coupler means. In a presently preferred embodiment, such assembly comprises an open box having a top, a bottom, and a pair of opposing sides each of which includes a complementary hole therethrough. The bottom also includes a hole through which the rod is adapted to extend.

A pair of support plates, each of which has a hole that is adapted for alignment with a respective complementary hole, are attached to and extend from the control valve body. Thereafter, pivot pins are inserted within the aligned holes of the support plates and the open box, and suitable means is provided to retain those pivot pins within the aligned holes. The open box is thereby adapted to pivot while attached to the control valve body. Since the operating means is attached to the bottom of the open box, it too will pivot when the open box pivots.

In order to maintain the applied effort along a line that is parallel to the rod, and achieve a simple, inexpensive design to manufacture, the effort maintaining means preferably comprises a biased "knuckle joint" between the lever means and the reciprocable rod. A knuckle joint, as is well known, is a hinge joint between two pieces in which an eye on one piece fits between two flat projections (each of which has an eye) on the other piece, retained by a round pin. In a presently preferred embodiment of this invention, such a biased knuckle joint is provided by a knuckle that is coupled to the second coupler means, attached to a distal end of the reciprocable rod, a spring seat that is attached to the knuckle opposite the distal end of the reciprocable rod, and a spring that is compressed between the spring seat and one end of the open box. The compressed spring provides a biasing force against the force of the reciprocable rod, thereby causing the open box together with the operating means and effort maintaining means to pivot about the second coupler means throughout the entire stroke of the reciprocable rod.

Other objects, advantages and features according to this invention will become readily apparent from the following detailed description thereof, when considered in conjunction with the accompanying drawings wherein:

DETAILED DESCRIPTION OF THE INVENTION

Figure 3:
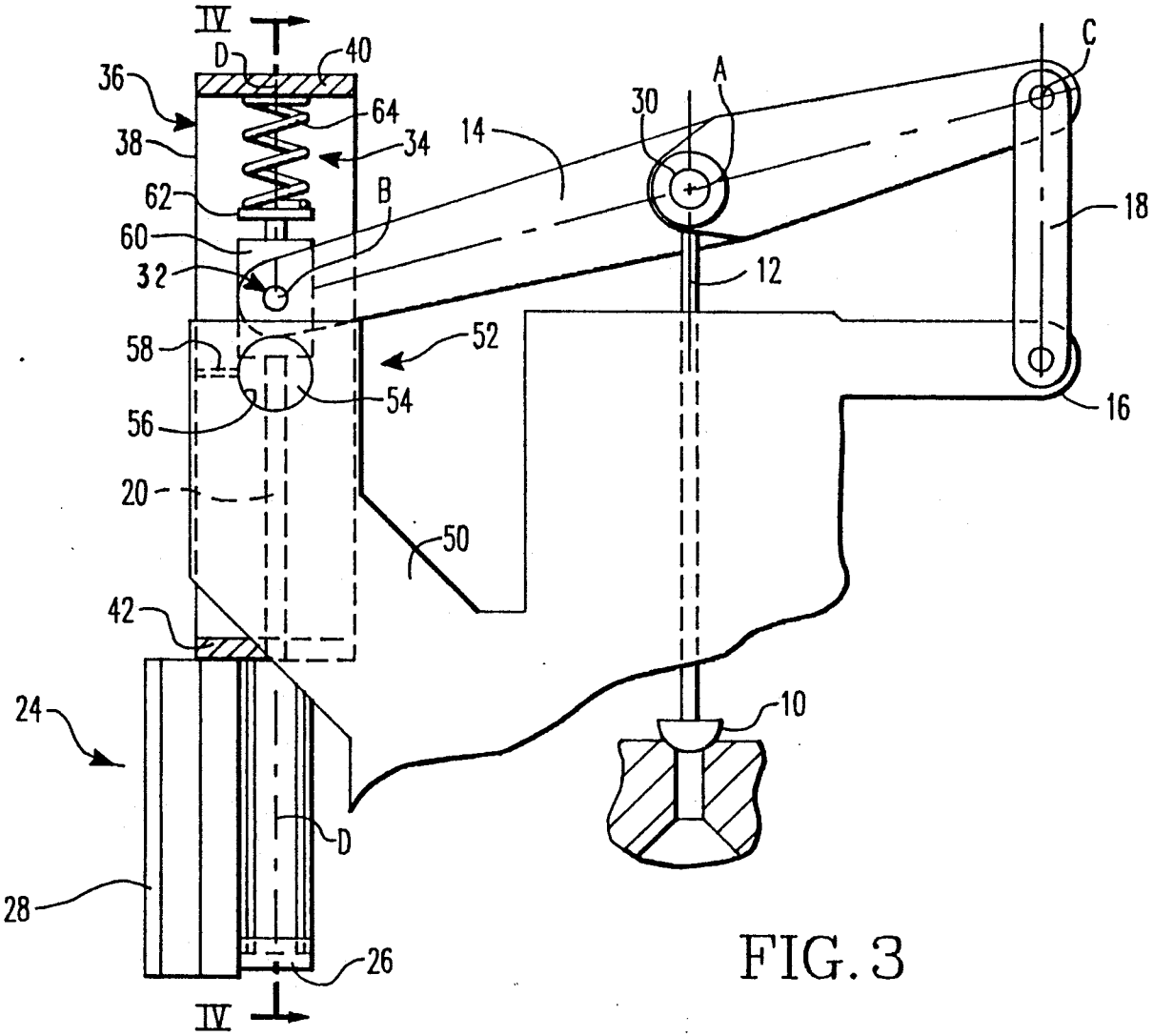
FIG. 3 shows a pivoting actuator means and support assembly for opening and closing a steam turbine control valve according to the present invention.
Figure 4:
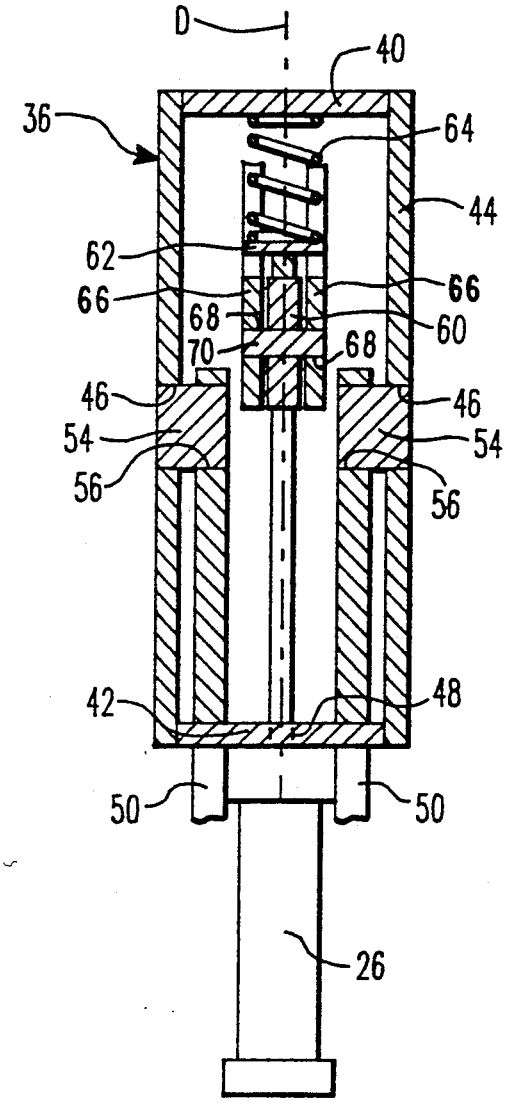
FIG. 4 is a view of the pivoting actuator means and support assembly shown in FIG. 3, taken along the lines 4—4.
Figure 5:
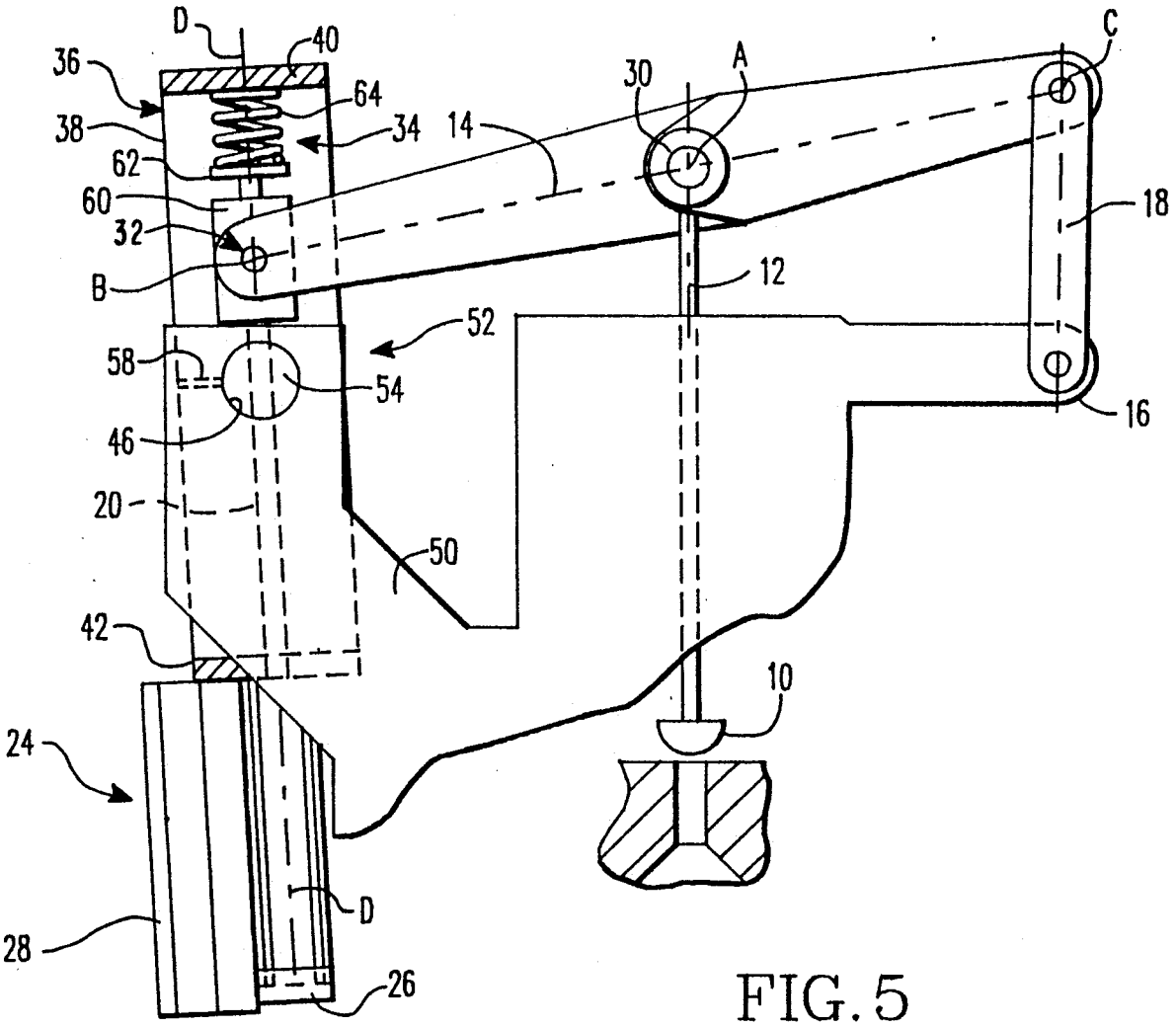
FIG. 5 depicts the pivoting actuator means and support assembly of FIG. 3, with the control valve shown at its open position.

Referring now to the FIGS. 3-5, wherein like element numerals designate like or corresponding parts throughout each of the several views, there is shown in FIG. 3 novel means for opening/closing a steam turbine control valve 10 according to the present invention.

Figure 1:
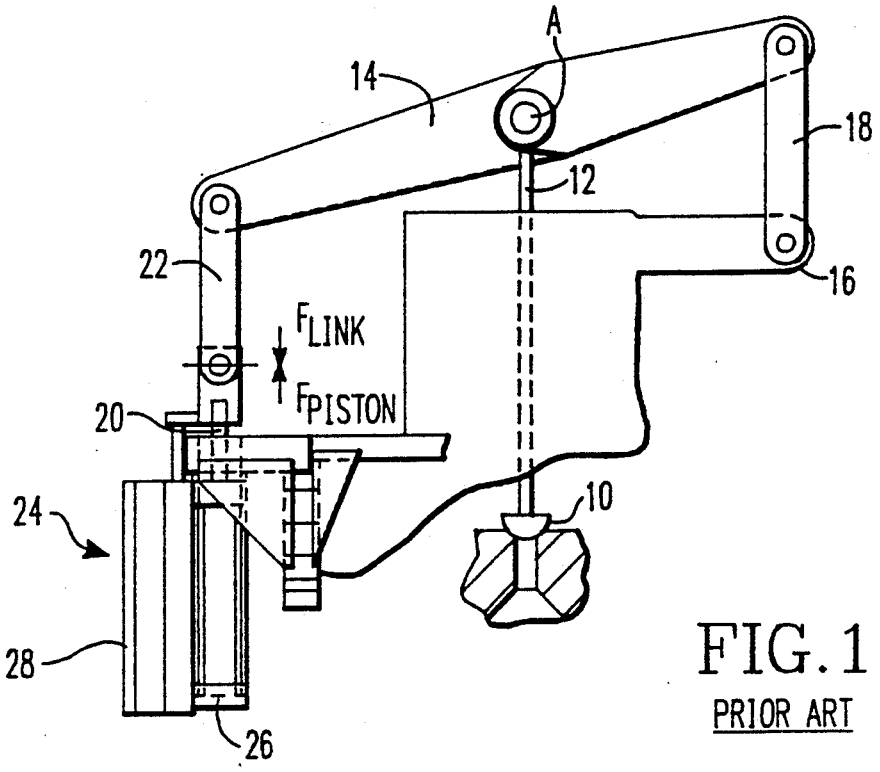
FIG. 1 PRIOR ART
FIG. 1 depicts an actuator means for opening/closing a steam turbine control valve according to the prior art, with the control valve shown at its closed position.
Figure 2:
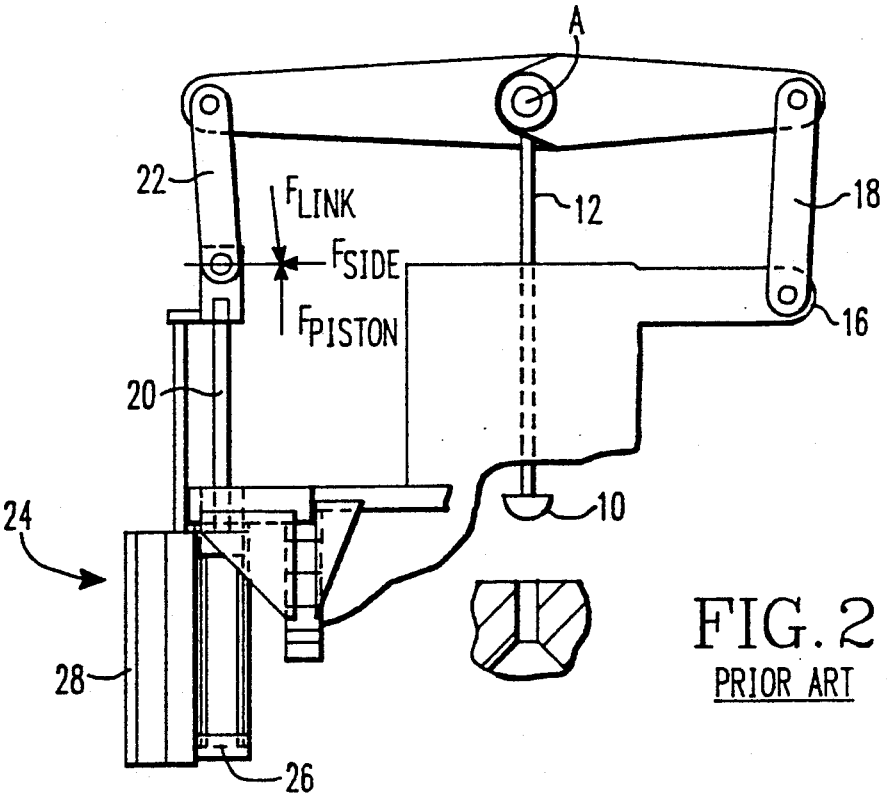
FIG. 2 PRIOR ART
FIG. 2 illustrates the actuator means of FIG. 1 with the control valve shown at its open position.

As with conventional actuator means of the prior art shown in FIGS. 1 and 2, the steam turbine control valve 10 has a valve stem 12 connected thereto for controlling an admission of steam into the steam turbine. Servomechanical means 24 for operating the control valve 10 are typically employed, and the operating means 24 usually includes a control block 28 adapted to receive control signals to open and close the control valve 10, with an actuator 26 having a reciprocable rod 20 extending therefrom. One end of lever 14 is connected to the rod 20 for operating the control valve 10 between its open and its closed positions. Since the lever 14 is coupled to the valve body through the fulcrum provided by steam chest portion 16, it may be considered a "third-class" lever.

That is, the lever is defined as a rigid bar which is free to pivot about an axis through a point referred to as its fulcrum. Force applied to the lever is called its effort, while the load which is to be overcome is termed a resistance. The location of the pivot point in relation to the resistance determines the lever's class. "Third-class" levers apply the effort on the same side of the fulcrum as the resistance, but on a much shorter arm. With a pivoting control valve actuator and support assembly according to the present invention, first coupler means 30 provides the resistance to valve stem 12, and rotatably couples the valve stem 12 to the lever 14. A second coupler means 32 applies the effort to lever 14, and rotatably couples lever 14 to reciprocable rod 20. Therefore, an effort arm is defined between points B and C along the lever 14 while a resistance arm is defined between points A and C along lever 14.

It should be readily appreciated, nevertheless, that other lever arrangements may be used in pivoting control valve actuator according to the present invention. For example, the fulcrum provided lever 14 may be equally located between valve stem 12 and actuator 26. Accordingly, other classes of levers are considered to fall within the scope of the invention.

According to an important aspect of this invention, a control valve actuator includes means for maintaining that effort along a line that is parallel to the reciprocable rod, and an assembly for supporting the operating means and housing the effort maintaining means with the second coupler means 32. In such a manner, the control valve actuators according to the present invention will pivot during extensions and retractions of their reciprocable rods 20 and, thereby, avoid undesirable side forces $F_{side}$ which have been experienced in the prior art.

Referring now also to FIG. 4, details of a pivoting control valve actuator and support assembly according to this invention will now be explained. An effort maintaining means 34 is housed within an assembly 36, which also supports lever 14. The assembly 36 suitably comprises an open box 38 having a top 40, a bottom 42, and a pair of opposing sides 44. Each of the opposing sides 44 (one of which, facing the viewer, is shown removed for the purposes of illustration in FIGS. 3 and 5) has a complementary hole 46, and the bottom 42 has a hole 48 through which the reciprocable rod 20 is adapted to extend. Attached to the control valve body and extending from the steam turbine are a pair of support plates 50. These support plates 50 provide a yoke 52 for containing a pair of pivot pins 54 for pivotably supporting the open box 38. Each of the support plates 50 includes a hole 56 adapted to be aligned with respective ones of the complementary holes 46 in the opposing sides 44 of the open box 38. Accordingly, each pivot pin 54 is inserted within the aligned holes 46, 56 of the support plates 50 and the open box 38, and those pivot pins 54 are held in place by any suitable means for retaining the inverted pivot pins 54 in respective pairs of the aligned holes 46, 56. One suitable such retaining means would be set screws 58 as shown in FIGS. 3 and 5.

The effort maintaining means 34 generally comprises a knuckle 60 which is coupled to the second coupler means 32, and is attached to the distal end of the reciprocable rod 20, a spring seat 62 which is attached to the knuckle 60 opposite the distal end of reciprocable rod 20, and a spring 64 which is compressed between spring seat 62 and one end of the open box 38. As is known, a "knuckle joint" is typically defined as the type joint between two pieces, in which an eye on one piece fits between eyes on two flat projections of the other piece, and the one piece is coupled to the other piece by a round pin. Lever 14 conventionally incorporates those flat projections 66, each with an eye 68. Therefore, knuckle 60 is formed by a providing a substantially square-shaped piece of rigid metal with an eye 70 that is bored therethrough and rotatably coupling that knuckle 60 to the projections 66 of over 14 by a knuckle/lever pin comprising the second coupler means 32.

The knuckle 60 is, thereafter, attached on one side to the distal end of the reciprocable rod 20 and on the other side to the spring seat 62. Side forces $F_{side}$ (FIGS. 1 and 2) which are experienced in the prior art control valve actuators are thus virtually eliminated by such designs, since a biasing force, provided by the spring 64, causes assembly 36 to pivot about the pivot pins 54. Accordingly, at any position of the lever 14 including a fully open position shown in FIG. 5, the substantially vertical operating force (i.e., $F_{piston}$ of FIGS. 1 and 2) provided by the reciprocable rod 20 will continue to act through a rotatable axis D that intersects centerlines of the aligned pivot pins 54, the knuckle 60, the knuckle/-lever pin 32, the spring seat 62 and the spring 64. Maintenance of those operating forces through rotatable axis D is assured by mounting the actuating means 24 to the bottom 42. Therefore, when the reciprocable rod 20 is extended or retracted through the hole 48 formed in the bottom 42, its operating force will always apply an effort to the lever 14 which is along a line parallel to the reciprocable rod 20.

What has been provided by the foregoing is a novel steam turbine control valve actuator, and method of coupling conventional lever-operated steam turbine control valves to their servomechanical actuators. Such apparatus and methods not only avoid problems of "side forces" experienced in the prior art, but also provide a simpler, yet inexpensive means of supporting those actuators. Simple methods of coupling a lever-operated steam turbine control valve to servomechanical means for actuating same are provided by avoiding the use of secondary linkages. Moreover, adjustment jackscrews are not necessary for maintaining the support assembly for such steam turbine control valve actuators in a desired position. Cast components are avoided by using plate materials for the open box.

Obviously, many modifications and variations of this invention are possible in light of the above teaching. Spring biasing means of any form may be readily substituted for those springs 64 taught herein (e.g., Belleville washers, bellows, other forms of springs such as leaf springs, or a compressed, resilient material). Moreover, the "open box" can be encased in order to prevent any undue interference with its mechanical components. The pivoting control valve actuator according to the present invention may also be used with control valves other than those in steam chests of a steam turbine.

It can be readily appreciated, therefore, that within the scope of the appended claims the invention may be practiced otherwise than as is specifically described herein.

What we claim is:

1. A steam turbine, comprising:

a control valve for controlling an admission of steam into the steam turbine;

a valve stem connected to said control valve;

means for operating said control valve, said operating means including a control block manifold adapted to receive control signals to open and close said control valve, and an actuator having a reciprocable rod extending therefrom, said reciprocable rod defining a centerline thereof;

lever means for operating said control valve, said lever means including a fulcrum that is attached to said control valve, first coupler means for providing a resistance to and rotatably coupling said valve steam with said lever means, and second coupler means for applying an effort along the centerline of said reciprocable rod and rotatably coupling said reciprocable rod with said lever means at said centerline of said rod;

means for maintaining said effort along said centerline of said rod throughout the travel of said rod, including:

an assembly for supporting said operating means and for housing said effort maintaining means and said second coupler means; and pivoting means supported on said assembly for pivoting said assembly and said operating means about an axis which intersects said centerline of said reciprocable rod.

2. The steam turbine according to claim 1, wherein said operating means comprises servomechanical means including means for extending said reciprocable rod to close said control valve and for retracting said reciprocable rod to open said control valve.

3. The steam turbine according to claim 1, wherein said assembly comprises a pair of support plates which are attached to and extend from the steam turbine to provide a yoke for supporting said pivoting means.

4. The steam turbine according to claim 3, wherein said assembly further comprises a box having a top end, a bottom end, and a pair of opposing sides each of which includes a complementary hole therethrough, said bottom end including a hole through which said reciprocable rod is adapted to extend; and wherein said pivoting means comprises a pair of pivot pins, each of which is inserted within said aligned holes of said support plates and said frame, thereby allowing said box to pivot with respect to said yoke.

5. The steam turbine according to claim 3, further comprising:

a knuckle coupled to said second coupler means and attached to a distal end of said reciprocable rod;

a spring seat attached to said knuckle opposite said distal end of said reciprocable rod; and a spring compressed between said spring seat and one end of said open box.

6. A control valve actuator for use with a control valve in a steam chest of a steam turbine, comprising:

a valve stem connected to the control valve;

a fulcrum attached to the steam chest;

a lever, coupled to said valve stem, pivotable about said fulcrum to raise and lower said valve stem thereby opening and closing the control valve;

means for applying an effort to said lever and overcoming a resistance of said valve stem so as to open and close the control valve, said effort applying means having a piston rod defining a centerline therethrough and acting along said centerline, said lever rotatably coupled to said rod along said centerline; and an assembly for supporting said effort applying means, said assembly having means supported on said assembly and pivotable about an axis which intersects said centerline for pivotally supporting said assembly and said effort applying means, thereby preventing said lever from imposing forces on said rod other than forces acting along said centerline throughout the travel of said rod.

7. The control valve actuator according to claim 6, wherein said effort applying means comprises:

a piston, said piston rod being extendable from and retractable into said piston;

a servomotor coupled to extend and retract said piston rod;

a knuckle attached to a distal end of said piston rod;

means for rotatably coupling said knuckle to said lever; and means for applying a bias force against said effort applied by said effort applying means.

8. The control valve actuator according to claim 7, wherein said pivotable supporting means comprises:

a yoke attached to and extending from the steam chest, said yoke including a pair of opposing holes;

a top plate, a bottom plate, and a pair of side plates forming said assembly each of which includes a hole adapted to be aligned with said pair of opposing holes;

a pair of pivot pins, each said pivot pin being inserted through a pair of said aligned holes for pivotally coupling said side plates to said yoke; and a pair of set screws, each of which is adapted to retain a respective one of said pivot pins attached to its respective side plate.

9. The control valve actuator according to claim 8, wherein said bias force applying means comprises:

a seat attached to said knuckle opposite said distal end of said piston rod; and spring means, disposed between said top plate and said seat, for substantially preventing a resultant side force from said coupling means and said effort applying means.

10. In a steam chest of a steam turbine having a lever-operated control valve with an actuator which includes a reciprocable piston rod defining a centerline thereof, the improvement comprising:

pivotable means for supporting the actuator so that the actuator pivots about an axis which intersects the piston rod centerline;

coupling means for coupling the piston rod along its centerline to the lever operating the control valve; and an assembly supporting said actuator for maintaining a force applied to the lever by the piston rod along the centerline of the piston rod throughout a stroke of the piston rod, said pivotable means supported on said assembly.

11. The improvement according to claim 10, wherein said pivotable supporting means comprises:

a frame forming said assembly, said frame having (i) a top plate, (i) a bottom plate having a central hole receiving the piston rod, the actuator being suspended from said bottom plate, and (iii) a pair of side plates each of which is attached to said top plate and to said bottom plate and includes a hole that is adapted to receive a pivot pin;

a pair of pivot pins each of which is inserted in a respective one of said holes in said side plate; and a pair of support plates for supporting said frame attached to the steam turbine, each said support plate having a hole that is adapted to receive one of said pair of pivot pins inserted within its respective side plate, whereby said frame pivots with respect to said support plates.

12. The improvement according to claim 11, wherein said coupling means comprises a knuckle joint which joins the lever with said piston rod.

13. The improvement according to claim 12, wherein said pair of support plates are attached to the steam turbine, separated from each other by a predetermined distance.

14. The improvement according to claim 13, wherein said predetermined distance comprises a distance accommodating said knuckle joint.

15. An actuator for a control valve, comprising:

a valve stem connected to open and close the control valve;

a fulcrum;

a lever, coupled to said valve stem, pivotable about said fulcrum to raise and lower said valve stem and to, thereby, open and close the control valve;

means for applying an effort to said lever and overcoming a resistance of said valve stem, to open and close the control valve, said effort applying means having a piston rod defining a centerline thereof, said lever rotatably coupled to said rod along said centerline; and a support assembly for supporting said effort applying means and having pivotable means supported on said assembly for pivoting said assembly and said effort applying means, said pivotable means adapted to pivot about an axis intersecting said centerline throughout the travel of said rod.

16. The control valve actuator according to claim 15, wherein said effort applying means comprises:

a piston, said piston rod being extendable from and retractable into said piston;

a control block manifold coupled to extend and retract said piston rod;

a knuckle attached to a distal end of said piston rod;

means for rotatably coupling said knuckle to said lever;

a seat attached to said knuckle opposite said distal end of said piston rod; and spring means, disposed for compression by said seat, and for substantially preventing a resultant side force from said coupling means and said effort applying means.

17. The control valve actuator according to claim 16, wherein said support assembly comprises:

a yoke attached to and extending from the steam chest, said yoke including a pair of opposing holes;

a housing assembly to which said effort applying means is attached having a top plate, a bottom plate, and a pair of side plates each of which includes a hole adapted to be aligned with said pair of opposing holes;

a pair of pivot pins, each said pivot pin being inserted through a pair of said aligned holes thereby pivotally supporting said housing on said yoke; and a pair of set screws, each of which is adapted to retain a respective one of said pivot pins attached to its respective side plate.

18. A method for coupling a lever-operated steam turbine control valve to a servomechanical actuator having means for applying an effort for operating said valve, the steam turbine control valve having a valve stem which is extendable in a first direction for opening the steam turbine control valve and retractable in a second, opposite direction for closing the steam turbine control valve, and wherein the servomechanical actuator includes a rod that is reciprocable along its centerline, said method comprising the steps of:

providing a supporting assembly for mounting the servomechanical actuator;

pivotably mounting said support assembly and said actuator to a body portion of the steam turbine control valve using pivoting means supported on said support assembly, whereby said support assembly is adapted for pivoting about an axis which intersects said centerline of said rod so that said actuator effort is applied along said centerline throughout the travel of said rod; and coupling a distal end of the rod along said centerline to the lever operating the steam turbine control valve.

19. The method according to claim 18, further comprising the step of providing a biasing force against the force of the rod in the first and second directions.

20. A steam turbine through which steam flows comprising:

a valve having a stem for controlling said flow of steam, said valve operated by a lever connected to said stem;

actuating means having a stroke means for applying an actuating force along a line to said lever for opening said valve;

biasing means for applying a biasing force along said line against said actuating means for closing said valve;

supporting means for supporting said actuating means and having pivoting means supported on said supporting means for pivoting said supporting means and said actuating means about an axis which intersects said line so that said bias force acts against said actuating means only along said line in a direction opposite to the direction in which said actuating force acts throughout the stroke of said actuating means.

* * * * *